US012760905B2

(12) United States Patent
Weber et al.

(10) Patent No.: US 12,760,905 B2
(45) Date of Patent: Oct. 13, 2026

(54) DOOR ASSEMBLY FOR AN OVEN APPLIANCE

(71) Applicant: ELECTROLUX APPLIANCES AKTIEBOLAG, Stockholm (SE)

(72) Inventors: Mario Weber, Rothenburg ob der Tauber (DE); Klaus Winkelmann, Rothenburg ob der Tauber (DE)

(73) Assignee: ELECTROLUX APPLIANCES AKTIEBOLAG, Stockholm (SE)

( * ) Notice: Subject to any disclaimer, the term of this patent is extended or adjusted under 35 U.S.C. 154(b) by 939 days.

(21) Appl. No.: 17/923,194

(22) PCT Filed: Apr. 9, 2021

(86) PCT No.: PCT/EP2021/059254
§ 371 (c)(1),
(2) Date: Nov. 3, 2022

(87) PCT Pub. No.: WO2021/223957
PCT Pub. Date: Nov. 11, 2021

(65) Prior Publication Data

US 2023/0160576 A1 May 25, 2023

(30) Foreign Application Priority Data

May 4, 2020 (EP) ..... 20172641

(51) Int. Cl.
*F24C 7/08* (2006.01)
*F24C 15/04* (2006.01)

(52) U.S. Cl.
CPC ..... *F24C 7/085* (2013.01); *F24C 15/04* (2013.01)

(58) Field of Classification Search
CPC .. H05B 6/6414; H05B 6/6447; H05B 1/0263; F24C 15/04; F24C 15/02–021;
(Continued)

(56) References Cited

U.S. PATENT DOCUMENTS 10,440,245 B1 * 10/2019 Johnson ..... H04N 23/57
2017/0208652 A1 * 7/2017 Luckhardt ..... G06T 7/55
(Continued)

FOREIGN PATENT DOCUMENTS

CN 210197365 3/2020
DE 102017125037 5/2019
(Continued)

OTHER PUBLICATIONS

International Search Report and Written Opinion for PCT/EP2021/059254, dated Jun. 21, 2021, 11 pages.

*Primary Examiner* — Ibrahime A Abraham
*Assistant Examiner* — Bonita Khlok
(74) *Attorney, Agent, or Firm* — Chrisman Gallo Tochtrop LLC

(57) ABSTRACT

A door assembly (6) for selectively providing access to, or closing, an oven cavity (5) of an oven appliance, the door assembly comprising: an outer pane element (9) comprising an at least partially transparent region; an inner pane element (10) spaced apart from the outer pane element comprising an at least partially transparent region; optionally one or more center pane elements (11, 12) located between the outer pane element and the inner pane element and comprising an at least partially transparent region; and a camera assembly (7) comprising an optical sensor (38) for obtaining image data from within the oven cavity; characterized in that the door assembly (6) further comprises: an aperture (25) which is provided in one of the pane elements (9, 10, 11, 12) and which accommodates the camera assembly (7).

19 Claims, 6 Drawing Sheets

(58) Field of Classification Search
CPC .... F24C 15/006; F24C 15/008; F24C 15/322; F24C 3/12–128; F24C 7/08–088; F25D 29/005; H04N 23/55
USPC ..... 219/739–740
See application file for complete search history.

(56) References Cited

U.S. PATENT DOCUMENTS

| | | | | |
|---|---|---|---|---|
| 2017/0261213 | A1* | 9/2017 | Park | H04N 23/57 |
| 2018/0216830 | A1* | 8/2018 | Ivanovic | F24C 7/085 |
| 2018/0372326 | A1* | 12/2018 | Park | F27D 21/02 |
| 2020/0063978 | A1 | 2/2020 | Erbe et al. | |
| 2021/0071874 | A1* | 3/2021 | Gopalakrishnan | F24C 15/006 |
| 2021/0341152 | A1* | 11/2021 | Johnson | F24C 15/04 |

FOREIGN PATENT DOCUMENTS

| | | |
|---|---|---|
| EP | 3263992 | 1/2018 |
| JP | 2006145142 | 6/2006 |
| WO | 2016034295 | 3/2016 |
| WO | 2016179424 | 11/2016 |

* cited by examiner

DOOR ASSEMBLY FOR AN OVEN APPLIANCE

The present invention relates to a door assembly for an oven appliance, and in particular to a door assembly for selectively providing access to, or closing, an oven cavity of an oven appliance.

Modern oven appliances for food preparation, referred to herein as cooking ovens, sometimes are equipped with camera systems for monitoring the interior of the oven cavity, for example to allow remote monitoring of the cooking progress such as by transmitting picture data to a remote device, for example a mobile phone, or to provide for automated cooking functions, such as by adjusting the temperature in dependency of a degree of browning of foodstuff that is prepared within the oven cavity.

While locating a camera within the oven cavity is problematic due to the conditions that may prevail within the oven cavity during a cooking process, such as high temperature and high humidity, it was suggested in the prior art to locate the camera at the exterior side of the oven door, where the camera is positioned so as to view into the oven cavity through a transparent window in the oven door. Such a device is disclosed in EP 3 263 992 B1 which describes a domestic appliance, in particular a domestic oven, having a treatment chamber and a door for selectively opening or closing the treatment chamber, wherein the door comprises at least one inner glass panel and one outer glass panel. In order to allow optically monitoring at least a part of the interior of the treatment chamber, a camera is mounted at the exterior side of the outer glass panel.

Another such device is disclosed in EP 3 194 853 B1 which describes a domestic appliance, in particular a cooking oven, which is equipped with a camera, wherein here the camera is arranged inside the door handle.

While the above solutions of providing camera monitoring for a food preparation oven are advantageous in as far as in these devices the camera is mounted at the exterior side of the oven and hence in a region that is not exposed to the high temperatures prevailing in the oven cavity, a problem experienced with such externally mounted camera systems is that the glass panes of the oven door are prone to reflections which may severely disturb the images obtained by the camera.

To alleviate the problems caused by reflections, it was suggested in the art to provide reflection shields, which however confine the area of sight where a user can look into the oven cavity through the transparent panes of the oven door or through a transparent window provided therein.

Furthermore, in U.S. Pat. No. 10,440,245 B1 there is disclosed an oven appliance in which the door comprises an outer glass pane, a middle glass pane and an inner glass pane, which panes are mounted with a spacing between the panes so as to provide for an inner and an outer air gap between the glass panes. A mounting bracket is positioned within the outer air gap and a camera is mounted to the mounting bracket so as to be oriented towards the oven cavity of the appliance. Also in such solution either there is provided a reflection shield or the mounting bracket itself may be configured to serve as a reflection shield.

It is an object of the present invention to provide a door assembly for an oven appliance which allows installing a camera for monitoring the oven cavity in a manner which avoids exposure of the camera to high temperatures, but which yet provides for better design flexibility than known solutions.

The above object is solved by the present invention which provides a door assembly for selectively providing access to, or closing, an oven cavity of an oven appliance, the door assembly comprising:

- an outer pane element comprising an at least partially transparent region;
- an inner pane element spaced apart from the outer pane element and comprising an at least partially transparent region;
- optionally one or more center pane elements located between the outer pane element and the inner pane element and comprising an at least partially transparent region; and
- a camera assembly comprising an optical sensor for obtaining image data from within the oven cavity;

In accordance with the present invention, such door assembly further comprises an aperture which is provided in one of the pane elements and which accommodates the camera assembly.

By providing an aperture in one of the pane elements, which aperture may be formed during molding the pane, or which may be formed by removal of a selected section of the pane element after forming the pane element, such as by cutting out the selected section, it becomes possible to install the camera assembly within the door, rather than exterior to the door, but with more space than in the known solutions. That is, given that the aperture accommodates the camera assembly, i.e. the camera assembly is mounted within the aperture, a mounting depth measured in a direction perpendicular to the plane of the pane element becomes available that corresponds to the thickness of the respective pane element plus the spacing between the respective pane element and the neighboring pane element, i.e. the width of the gap between the pane elements. In case that the door assembly in addition to the outer and the inner pane elements comprises one more center pane elements, and wherein the camera assembly is mounted within an aperture that is provided in one of the center pane elements, the available mounting depth is even larger since it comprises the thickness of the respective pane element plus the widths of both the gaps between the center pane element the aperture of which accommodates the camera assembly and the neighboring pane elements. In embodiments, in which the aperture is provided in the inner pane element or the outer pane element, as will be discussed in further detail below, there basically is no restriction as regards the mounting depth for the camera assembly, which in such embodiments will be basically determined by aspects of technical necessity and design.

A further advantage achieved by the present solution, which will also be discussed in further detail below, is that by installing the camera assembly in an aperture provided in one of the pane elements, the camera assembly is exposed to the atmospheres prevailing on both sides of the respective pane element in which the aperture is formed which thus facilitates the heat transfer through the camera assembly, thus avoiding high and potentially damaging temperatures for the camera assembly. For example, when the camera assembly is installed in an aperture that is provided in the outer pane element of an oven door comprising three spaced apart pane elements, i.e. an outer pane element, a central pane element and an inner pane element, the side of the camera assembly where the optical sensor is located, herein referred to as "front side", will be exposed to the temperature prevailing within the gap between the outer pane element and the central pane element, whereas the opposite side of the camera assembly, herein referred to as "rear side", will be exposed to ambient temperature. Hence, even if the temperature prevailing in the gap between the outer pane element and the central pane element might reach values which as such could be detrimental to the camera assembly, the door assembly suggested herein avoids a potentially damaging warming of the camera assembly because heat from the camera assembly will be effectively withdrawn at its rear side.

The concept suggested herein can be applied to any kind of cooking oven, be it a domestic cooking oven or an industrial cooking oven, and irrespective of the kind of heating system employed. Thus the concept suggested herein can be applied to any kind of cooking oven, such as an oven having electric heating coils, a hot air oven, a steam oven, a microwave oven, a gas oven, or a device that combines any of these heating types.

In particular, the door assembly can comprise at least one center pane element, in which case the aperture can be provided selectively in the inner pane element, the outer pane element or any of the center pane elements.

Selecting the pane element in which the aperture for accommodating the camera assembly is provided, can be made dependent on the type of oven appliance in which the door assembly is to be employed. For example, given that in a microwave oven it is not the oven cavity as such that is heated, but the food items processed therein, and hence in the oven cavity of a microwave oven temperatures are experiences that are much lower than in an oven having electric heating or a gas-fired oven, in a microwave oven the camera assembly can be mounted in closer proximity to the oven cavity, and thus the aperture also could be provided in the inner pane element.

On the other hand, in an oven having electric heating or in a gas-fired oven in which it is the oven cavity as such that is heated, wherein the door assembly may comprise several spaced apart pane elements, such as an outer pane elements, an inner pane element and one or more center pane elements, wherein further there may be provided for active cooling of the pane elements by flowing a stream of air through the gap between adjacent pane elements, the aperture for accommodating the camera assembly preferably is provided in a pane element that is located at a distance to the oven cavity. Thus, the aperture can be provided for example in the outer pane element or in a central pane element, such as in the outermost center pane element where the camera assembly can be mounted in a concealed manner in which it is not visible to a user, but wherein yet it is effectively protected from the harsh environment that may prevail within the oven cavity and which may involve high temperatures and/or high humidity.

In preferred embodiments the camera assembly comprises a housing which is configured for being mounted in the aperture, preferably by snap-in connection.

The housing for the camera assembly thus can be designed to serve a double function, i.e. on the one to enclose any components of the camera assembly, and on the other hand to facilitate the mounting of the camera assembly in the aperture.

Considering that in terms of the viewing angle a most advantageous position for the camera assembly will be at an elevated position with respect to the oven cavity, in preferred embodiments the housing can be configured for mounting the camera assembly such that the optical sensor is inclined with respect to the pane elements. In embodiments in which the camera assembly comprises a PCB camera module, i.e. a camera module that comprises a printed circuit board, on which there are mounted the various components for operating the camera assembly, such as a CMOS imaging sensor and circuitry for operating the same, the housing may comprise support elements, such as slanted surfaces, on which the printed circuit board can be mounted so as to be oriented at an angle with respect to the orientation of the pane elements.

Furthermore, the housing may comprise a lens that is provided at one of the walls of the housing and which may serve not only to improve the quality of images obtained, but which also may be provided to protect the optical sensor, such as by preventing dirt particles from reaching the optical sensor and/or providing for an additional thermal barrier between the optical sensor and the atmosphere surrounding the camera assembly.

In embodiments in which the camera assembly comprises a housing configured for being mounted in the aperture, preferably by snap-in connection, the housing can comprise one or more pawls for fixing the camera assembly within the aperture. In such manner, the camera assembly can be configured as a pre-assembled unit which for mounting at the door assembly simply needs to be engaged in the aperture and electrically connected, such as by means of a plug connection.

In an alternative embodiment, the housing comprises a first housing element configured to be mounted at the aperture at a first side of the pane element comprising the aperture, the housing further comprising a second housing element configured to be mounted at the aperture at a second side of the pane element opposite the first side. In such embodiment, one or both of the housing elements may be configured to rest against the pane element about the rim of the aperture, such as by the housing element having a size that is larger than the aperture, or by the housing element having support elements, such as lateral projections, that rest against the pane element.

While the first and second housing elements may be configured not to contact each other, such as to rest against the respective side of the pane, in preferred embodiments the first and second housing elements are configured for engaging each other, and preferably for a locking engagement with each other, in which manner no additional or separate means have to be provided for holding together the first and the second housing elements.

Overheating of the camera assembly can be further prevented by providing the housing with at least one aperture for flowing air through the housing.

Whereas such aperture in the housing can be single aperture that provides for both ingress of air into the housing and for removal of air from the housing, either by convection or by air that is actively passed through the one or more gaps between the pane elements, guiding air through the housing can be further promoted by providing more than one aperture, wherein at least one of the apertures serves as inlet for air into the housing and at least one other of the apertures serves as outlet for air out of the housing.

The cooling action can be even further promoted by designing the door assembly such that the housing comprises at least one first aperture in a region of the housing which is located on a first side of the pane element comprising the aperture, and at least one second aperture in a region of the housing which is located on a second side of the pane element opposite the first side.

In such embodiments air can flow through the pane element, thus making use of the fact that the air on one side of the pane element may be cooler than the air on the other side of pane element. For example, when the camera assembly is installed in an aperture that is provided in the outer pane element of an oven door comprising three spaced apart pane elements, i.e. an outer pane element, a central pane element and an inner pane element, by providing for an air stream flowing through the gap between the outer pane element and the central pane element, such as by operating a fan element that is connected to the gap, such air stream will result in air to be drawn from within the housing into the gap, which draw in turn will result in ambient air being drawn into the housing, thus cooling the camera assembly.

As noted above, when the door assembly is to be employed in an oven in which the oven cavity is heated, a most efficient cooling of the camera assembly can be achieved, when the camera assembly is mounted in an aperture that is provided in the outer pane element, which during use of the oven appliance is exposed to the lowest ambient temperature.

In the alternative, when the door assembly is to be employed in a microwave oven in which during use the oven cavity is at a much lower temperature, or also when the door assembly is to be employed in an oven in which the oven cavity is heated, but wherein no excessive temperatures occur in the vicinity of the camera assembly, be it because there is provided for cooling air to the camera housing, or because the door assembly comprises multiple panes of which the outer ones do not experience higher temperatures, or simply because the camera assembly as such has a temperature tolerance that allows mounting the camera assembly in a warmer region, the camera assembly also can be mounted in one of the center pane elements, in which manner the camera assembly can be mounted to not be visible from the exterior.

In preferred embodiments the door assembly further can comprise one or more support elements for mounting the pane elements in a spaced relationship.

To this end the door assembly may comprise a support frame that extends along the circumference of the door and which comprises fixtures for holding the pane elements. Instead of a support frame that extends along all four sides of a rectangular door, there can be provided two support elements at opposing sides of the pane elements, such as a first support element that extends along the bottom side of the door assembly and a second support element that extends along the upper side of the door assembly, which support elements are configured for mounting the pane elements in a spaced relationship. In such latter embodiment there may be provided additional structural elements that extend along the lateral sides of the door assembly and which maintain the positional relationship of the first and second support elements.

It further should be understood that if present, such support elements for mounting the pane elements in a spaced relationship need not extend along the entire length of any of the sides of the door assembly, but also can be provided only in certain regions, for example in the vicinity of the corners of a rectangular door assembly.

In embodiments in which the outer pane element and/or the inner pane element shall extend over the entire size of the door assembly, such as to provide for a door assembly in which the outer and/or the inner pane element is a frameless glass element, the pane elements can be sized such that the outer and/or inner pane element is/are larger than any center pane element, so that support elements can be provided which embrace the center pane element or elements, but which are attached to the inner face of the outer and/or inner pane element.

Particularly when the door assembly comprises an outer and/or inner pane element, that extends generally over the entire size of the door assembly, so as to provide for a door assembly in which the outer and/or inner pane element is a frameless glass element or a glass element having only a slim frame the size of which is not sufficient to hide structural elements at the rear side of the respective pane, at least the outer and/or inner pane element can comprise regions in which the transparency of the pane element is reduced or eliminated. This can be effected by providing for blinds in regions where there are structural elements, which blinds may comprise a sheet of a non-transparent material that is provided at the rear side of the pane. The assembly can be further facilitated by providing for a coating or printing in such regions.

In further embodiments of the door assembly of the present invention there can be provided an anti-reflection element that prevents or reduces light transmissivity of selected areas of the pane element which comprises the aperture in which the camera assembly is mounted, so as to avoid or reduce disturbances in the images captured by the optical sensor caused by incident light. While the anti-reflection element may comprise a shield that is installed in the region where the optical sensor is installed, in preferred embodiments the anti-reflection element comprises a coating or printing on a surface of the pane comprising the aperture in which the camera assembly is mounted at least in the vicinity of the camera assembly. In a door assembly in which there is provided a printing at the rear side of one of the pane elements, such as a frame printing that is provided to conceal structural elements of the door assembly, the anti-reflection element thus can be provided in a simple manner by extending the frame printing to cover also a region about the camera assembly where reflections might occur.

In further embodiments, the anti-reflection element can be formed by metallizing respective regions of the pane element, so that a mirror surface is formed in these regions.

Particularly for embodiments in which the picture data obtained by the camera assembly is to be used to provide for automated control functions of the oven in which the door assembly is to be installed, there can be provided an indicator such as a light-emitting diode which may be provided for example in the housing of the camera assembly and which is powered when the camera assembly is operative. In this manner operation of the camera assembly is confirmed to the user also in situations in which no picture data may be provided to the user.

In a further aspect the present invention provides a cooking oven comprising a door assembly as it is referred to above.

In embodiments in which the cooking oven has a microwave heating capability and hence comprises a source for microwave radiation, and wherein the door assembly comprises a microwave shielding mesh mounted alongside one of the inner pane elements, the cooking oven preferably further comprises an image evaluation unit configured to analyze the camera images, to detect disturbances caused by the microwave shielding mesh, and to compensate these disturbances by processing the image data. Thus, while the camera assembly is to be installed such that the microwave shielding mesh is located between the camera assembly and the oven cavity, so as to avoid damage of the camera assembly by microwave radiation, for obtaining images from the oven cavity the optical sensor necessarily has to look through the microwave shielding mesh. Whereas the mesh thus inevitably causes disturbances in the image data obtained from the oven cavity, such disturbances can be compensated for by applying in the image evaluation unit that is used to analyze the camera images algorithms which apply mathematical operations on the image data to eliminate these disturbances. In simplified terms, the algorithm is configured to detect in the camera images the pattern of the microwave shielding mesh and replaces the image data in the thus detected areas by data that is obtained by interpolating the image data obtained from disturbance-free regions.

BRIEF DESCRIPTION OF THE DRAWINGS

The present invention will be described in further detail with reference to the drawings from which further features, embodiments and advantages will become apparent, and in which.

DETAILED DESCRIPTION OF THE DRAWINGS

Figure 1:
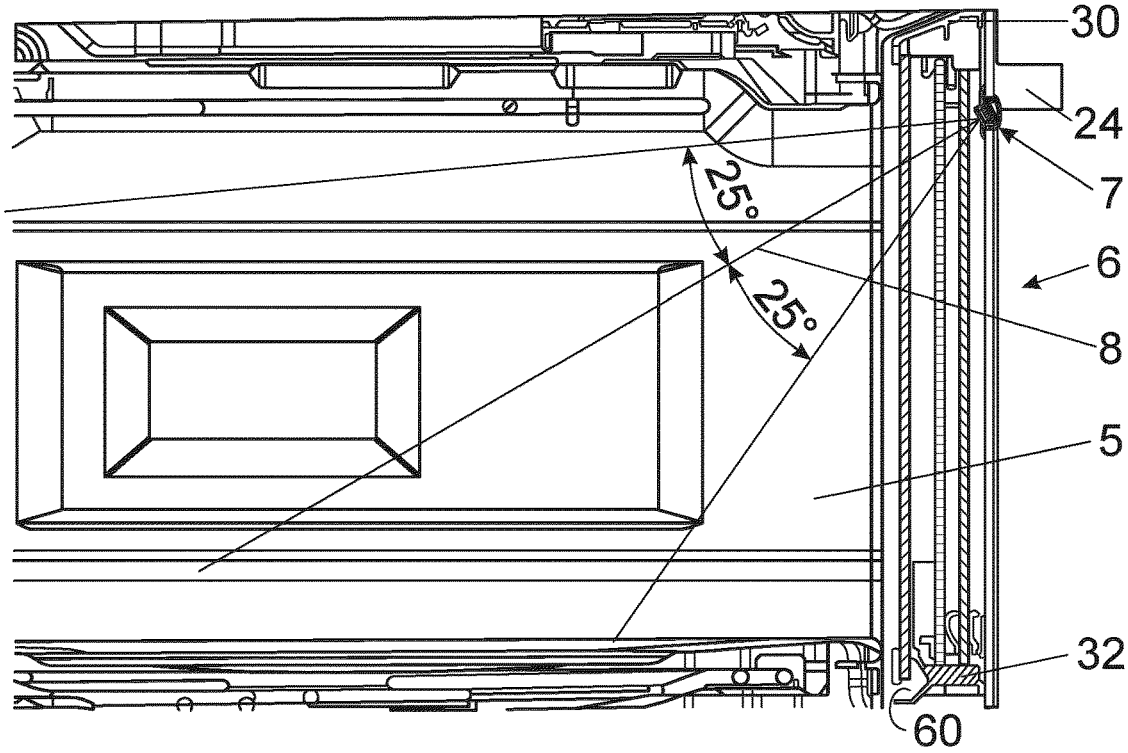
FIG. 1 illustrates a schematic sectional view of an oven appliance in accordance with the present invention.

As illustrated in FIG. 1 which shows a schematic sectional view of an oven appliance in accordance with the present invention, the oven appliance comprises an oven cavity 5 and a door assembly 6 for selectively providing access to, or closing, the oven cavity 5.

Figure 2:
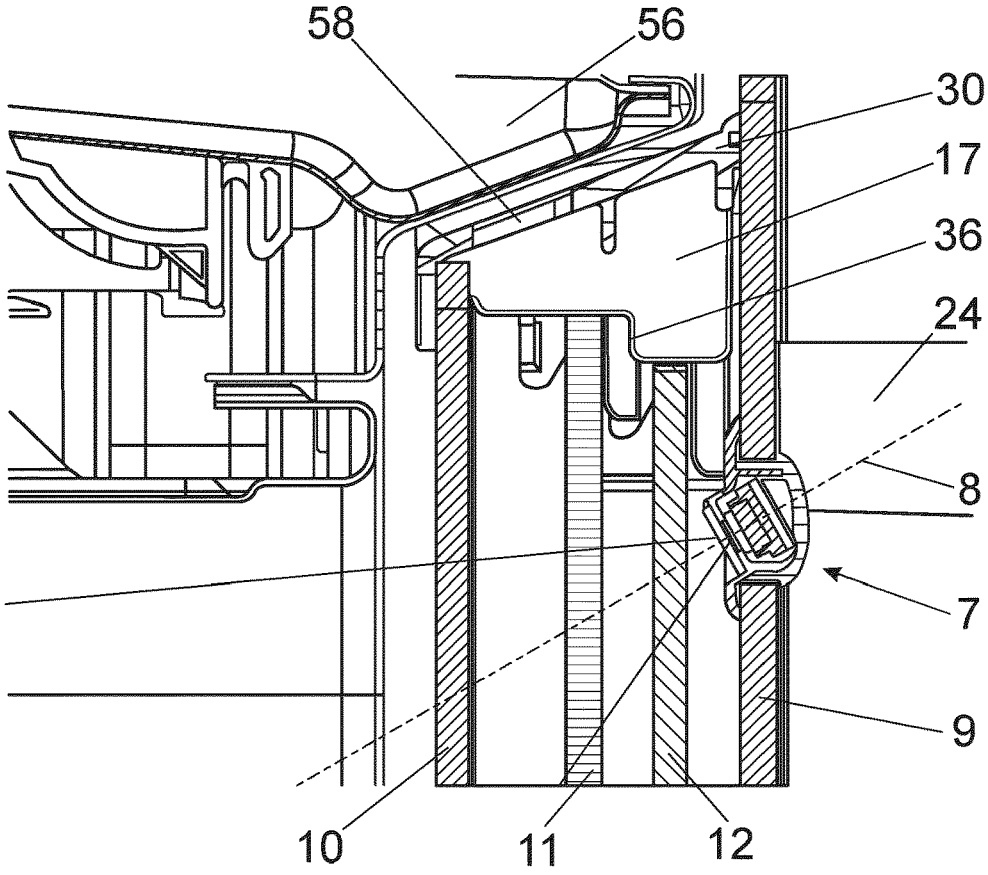
FIG. 2 illustrates an enlarged sectional view of the oven appliance illustrated in FIG. 1.

In the embodiment illustrated in FIG. 1, and in enlarged view in FIG. 2, the door assembly 6 comprises a series of pane elements which all have an at least partially transparent region so as to allow a user to look from the outside into the oven cavity 5. In the embodiment shown, the door assembly 6 comprises an outer pane element 9, an inner pane element 10 and two center pane elements 11 and 12 which all can be made of an at least partially transparent material such as glass or glass ceramics. In the upper region of the outer pane element 9 there is provided a handle 24 which facilitates manipulating the door assembly 6 during opening and closing.

In the accompanying drawings door assembly 6 is illustrated to comprise a camera assembly 7 which is mounted in an aperture 25 that is provided in the outer pane element 9.

As can be seen best in FIG. 1 camera assembly 7 is mounted at an elevated position with respect to the oven cavity 5, wherein as will be explained in further detail by reference to FIG. 3 the optical sensor of the camera assembly is mounted to be inclined with respect to the pane elements. In the exemplary embodiment illustrated in FIG. 1 the camera has a viewing angle, i.e. an angular range covered by the camera, of 50 degrees which in the illustrated oven geometry allows to view the mayor part of the oven cavity. Of course, the orientation of the optical sensor as illustrated by the longitudinal axis 8 of the optical sensor may differ from the one shown in the drawings, as well as cameras having a different viewing angle, such as a wider viewing angle, can be employed.

In order to provide for a door assembly in which the outer pane element 9 also during use of the oven appliance is at a temperature close to room temperature so that a user may touch the outer pane element 9 without having to fear an unpleasant temperature sensation, the pane elements are located at a distance to each other to thus provide for a gap between adjacent pane elements. These gaps serve as a thermal barrier by providing for a resistance to heat flow between adjacent pane elements. Furthermore, particularly for use of the door assembly in ovens in which the oven cavity may be heated to high temperatures such as by means of electrical heating elements, the gaps between adjacent pane elements can be used to remove heat from the panes by flowing air through the gaps.

In the illustrated embodiments the pane elements are held at a frame of which in FIGS. 1 and 2 an upper frame element 30 and a lower frame element 32 can be seen. Whereas outer pane element 9 is attached to the front sides of upper frame element 30 and of lower frame element 32, the center pane elements 11 and 12 are held at the upper and lower frame elements 30 and 32 by means of fixtures 34 which clamp the center pane elements 11 and 12 between adjacent fixtures and which provide for a spacing between the pane element. As illustrated in FIG. 2, inner pane element 10 is clamped between a protruding rim of upper frame element 30 and a hollow frame element 36 which carries the fixtures 34.

Figure 3:
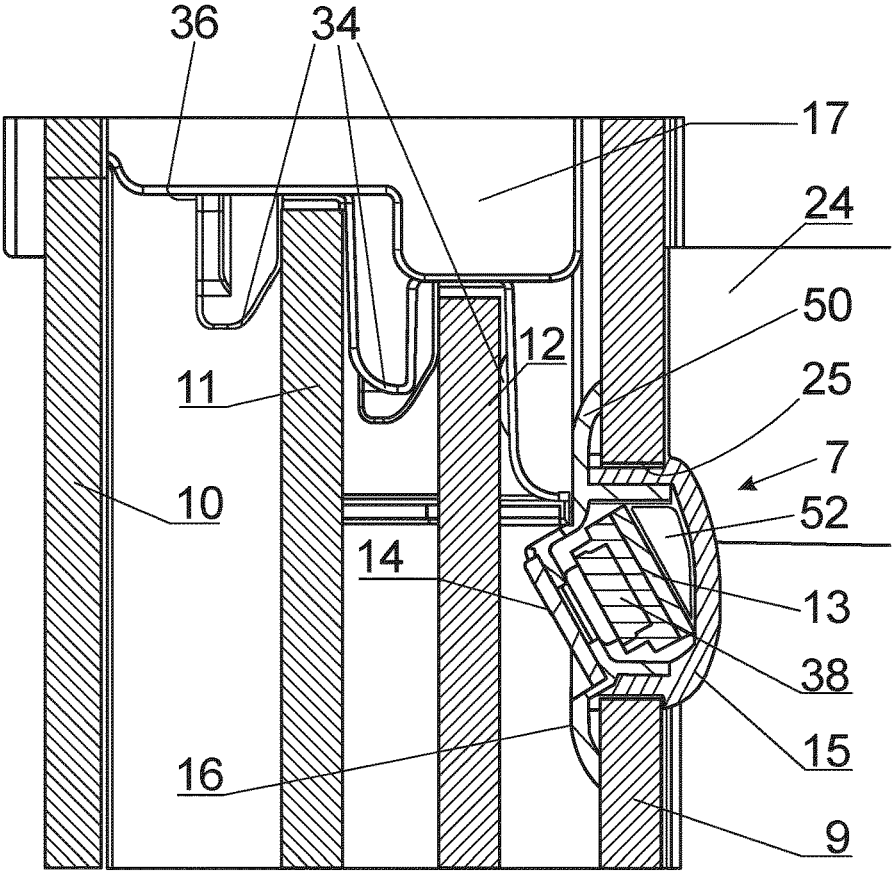
FIG. 3 illustrates an enlarged sectional view of the door assembly of the oven appliance illustrated in FIG. 1.
Figure 4:
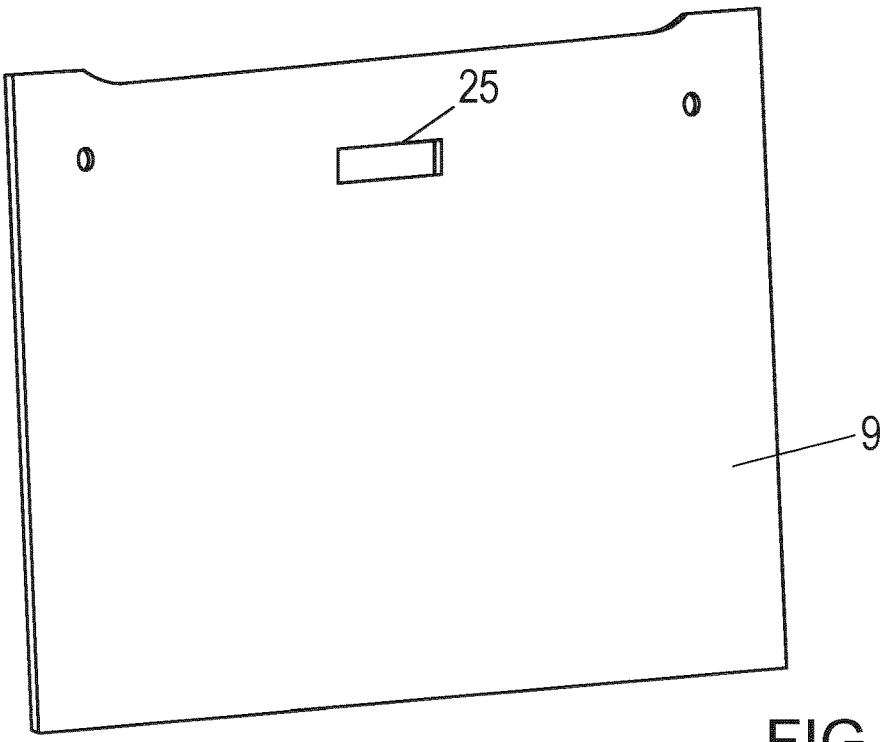
FIG. 4 illustrates a perspective view of a pane element of a door assembly in accordance with the present invention.
Figure 6A:
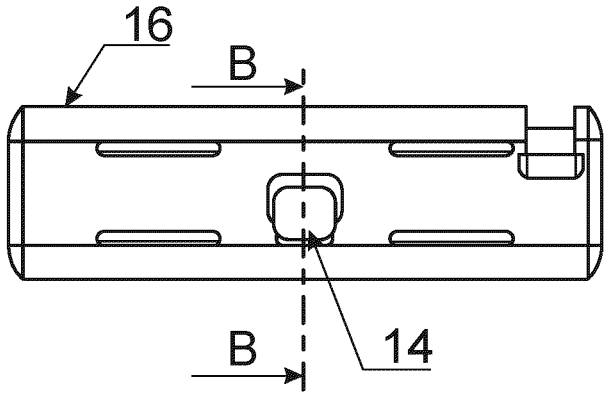
FIG. 6A is a front view of a camera assembly of a door assembly in accordance with the present invention.
Figure 6B:
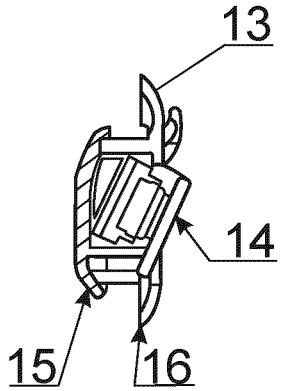
FIG. 6B is a sectional view of the camera assembly along line B-B of FIG. 6A.
Figure 6C:
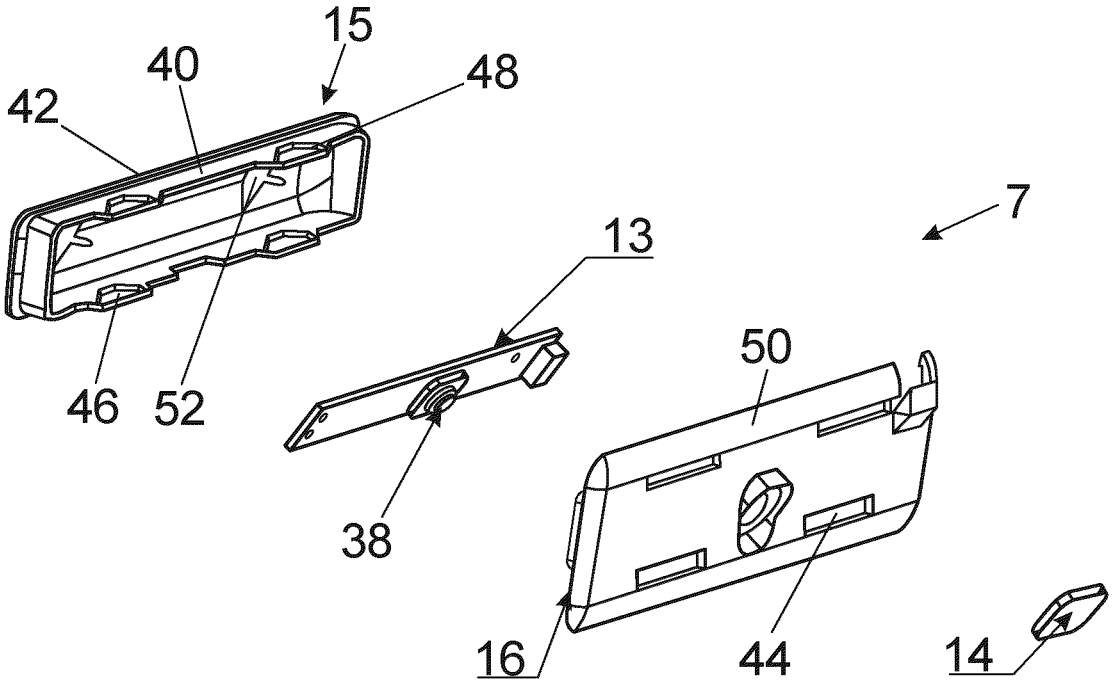
FIG. 6C illustrates an exploded view of the camera assembly shown in FIGS. 6A and 6B.

As can be best seen in FIG. 3 as well as in the views of FIGS. 6A to 6C, the camera assembly 7 which is installed at the outer pane element 9 comprises an optical sensor 38 which is mounted on a printed circuit board 13 on which there may be provided further elements for operating optical sensor 38 and/or for processing image data obtained from optical sensor 38. Printed circuit board 13 is encapsulated within a housing which comprises a first housing element 15 and a second housing element 16. In the illustrated embodiment first housing element 15 is designed as a hollow box-shaped element for accommodating the printed circuit board 13 and a second housing element 16 is configured as a cover or lid for the box-shaped first housing element 15. First housing element 15 has a circumferential wall having a shape which generally conforms to the shape of an aperture 25 provided in pane element 9 (see also FIG. 4).

First housing element 15 further has a protruding rim 42, which when the first housing element 15 has been inserted into aperture 25 rests against the front side of outer pane element 9. At its free end facing away from protruding rim 42, circumferential wall 40 may have a plurality of pawls protruding laterally outwards from circumferential wall 40 so as to provide for a latching of the first housing element 15 at the rim of aperture 25 when the first housing element 15 has been inserted into the aperture.

In the illustrated embodiment the camera assembly 7 is fixed at outer pane element 9 by inserting the first housing element 15 from the front side of outer pane element 9 into the aperture and then attaching the lid-shaped second housing element 16 to the first housing element 15. To provide for a latching engagement of the first and second housing elements, second housing element 16 comprises slots 44 into which on assembly of the camera housing elevated sections 46 of the circumferential wall of the first housing element 15 are inserted and are locked by means of pawls 48 provided at the elevated sections 46. The locking engagement of the first and second housing elements and 16 provides for a fixing of the camera assembly 7 within aperture 25 wherein there can be provided for a clamping action with respect to the pane element 9 by providing for resiliency of the protruding rim 50 of the second housing element 16, so that when pushing the second housing element 16 onto the first housing element 15 the protruding rim 50 is slightly deformed to thus provide for a clamping force against the portion of the pane element 9 that surrounds aperture 25.

As can be best seen in FIG. 3 and FIG. 6C the first housing element 15 comprises slanted support elements 52 for supporting the printed circuit board 13 at an angled orientation, so that when the camera assembly 7 is mounted within aperture 25 the optical sensor 38 is oriented such that its longitudinal axis 54 (see FIG. 7) extends at an angle so as to provide for a downwardly inclined view of the optical sensor 38. In order to provide for protection of the optical sensor and, as necessary, to assist in obtaining good quality images, the camera assembly 7 further comprises a lens 14 which covers an opening in the second housing element 16 where the optical sensor 38 is mounted.

Figure 5:
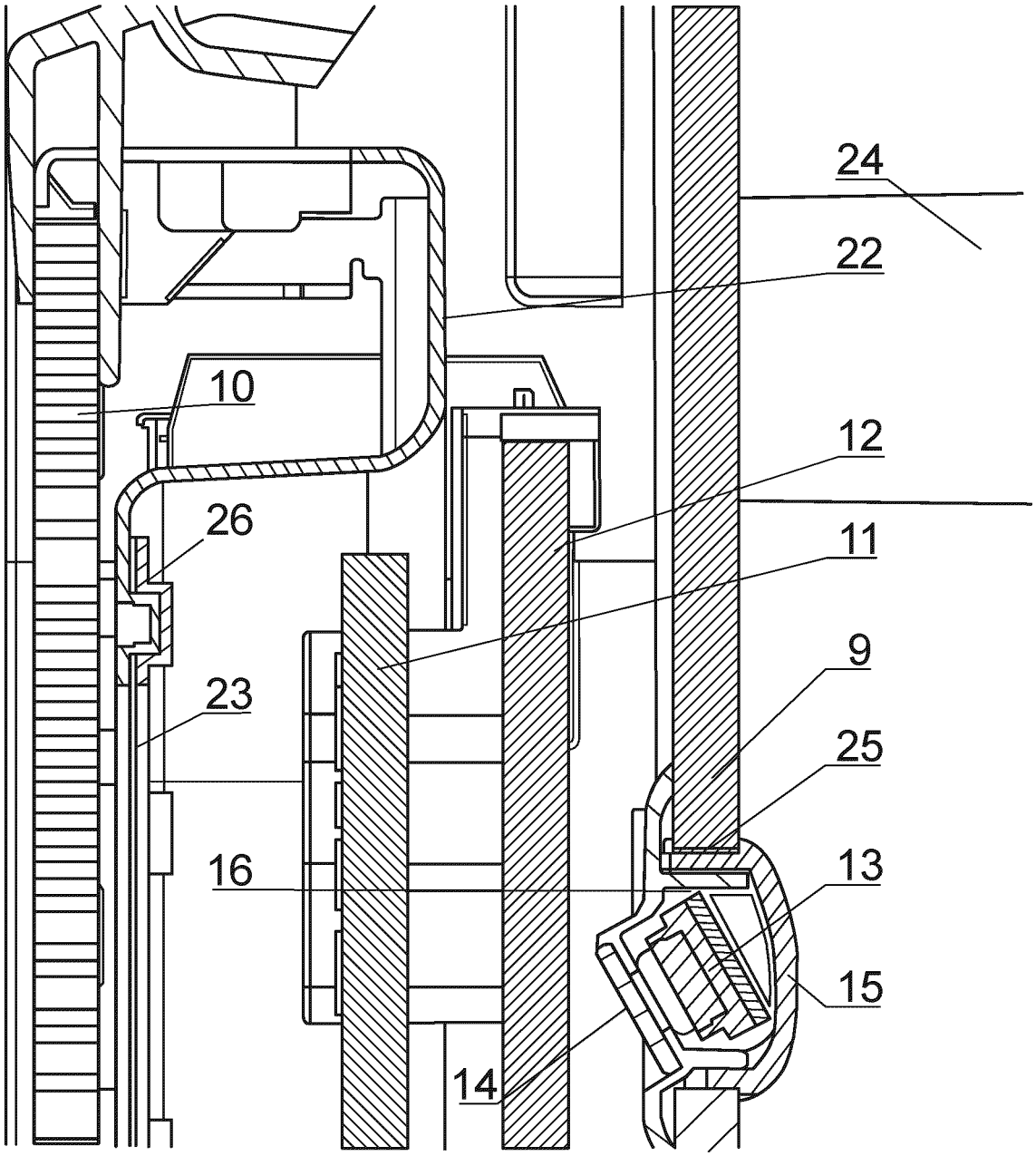
FIG. 5 is a sectional view of a microwave oven in accordance with the present invention.

FIG. 5 shows an embodiment of a door assembly which is configured for use in a microwave oven. While the general construction including the implementation of the camera assembly may be the same as in the embodiment shown in FIGS. 1 to 3, the embodiment of FIG. 5 further comprises a microwave shielding mesh 23 which is mounted along the face of the inner pane element 10 which faces away from the oven cavity. To facilitate mounting of the microwave shielding mesh 23 which prevents microwave radiation from passing through the door assembly, FIG. 5 illustrates a mesh frame 26 which is attached to the inner pane element 10 and which extends along the circumference of the pane element to cover the area of the viewing window provided by the inner pane element 10.

For oven appliances in which the oven cavity can be heated to high temperatures, particularly in ovens that are configured to provide for a pyrolytic cleaning function in which the oven cavity is heated to temperatures as high as about 500° C., the door assembly advantageously is provided with an active air cooling function in which air is passed through the gaps between the pane elements.

In embodiments illustrated in the drawings, such active air cooling is implemented by providing, for example, above the oven cavity, for an electric fan that provides for a draft to a chamber 56 which when the oven door is closed communicates via an opening 58 in upper frame element 30 with a vent channel 17 which is formed by upper frame element 30 and frame element 36. By activating the fan and thus providing a draft in chamber 56, air is withdrawn from the gaps between the panes such as to be vented from the oven assembly, wherein the air within the gaps which has been warmed by taking up heat from the adjacent pane elements is replaced by cooler air that is drawn into the gaps via an air inlet 60 that is provided along the bottom edge of the door assembly (see FIG. 1).

Figure 7:
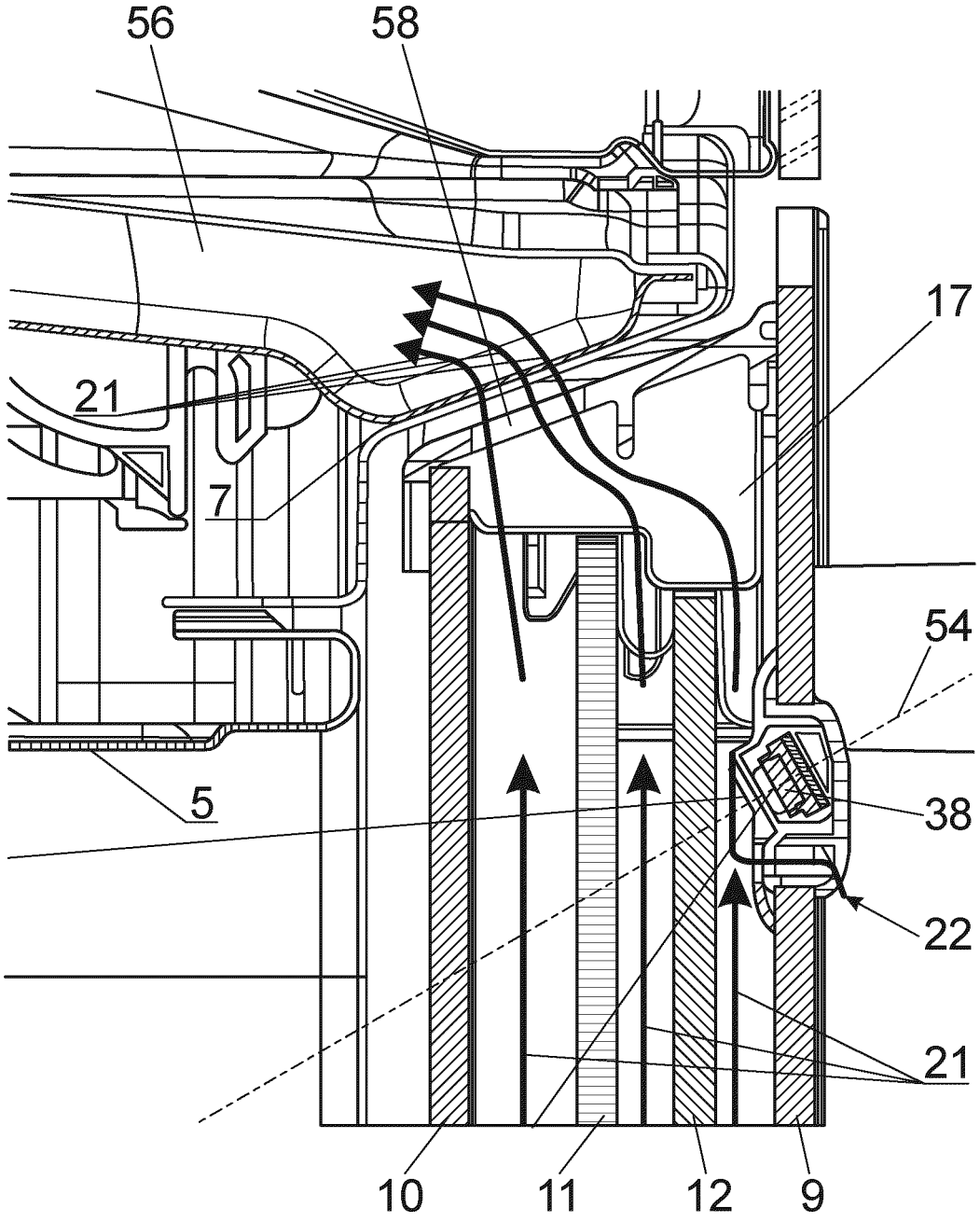
FIG. 7 illustrates an enlarged sectional view of a further embodiment of a door assembly in accordance with the present invention.
Figure 8A:
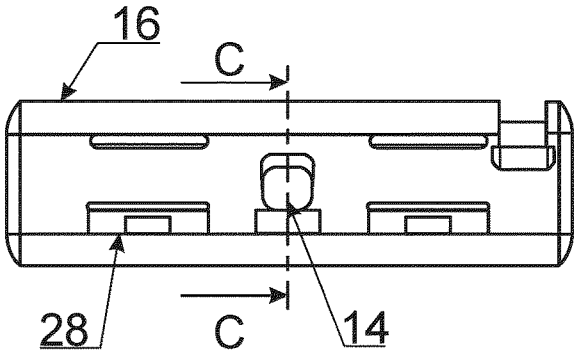
FIG. 8A is a front view of another embodiment of a camera assembly of a door assembly in accordance with the present invention.
Figure 8B:
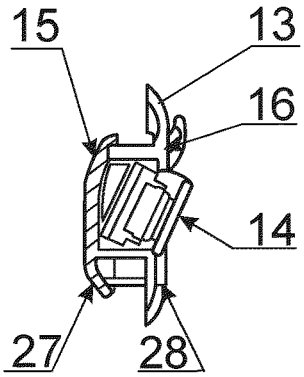
FIG. 8B is a sectional view of the camera assembly along line C-C of FIG. 8A.
Figure 8C:
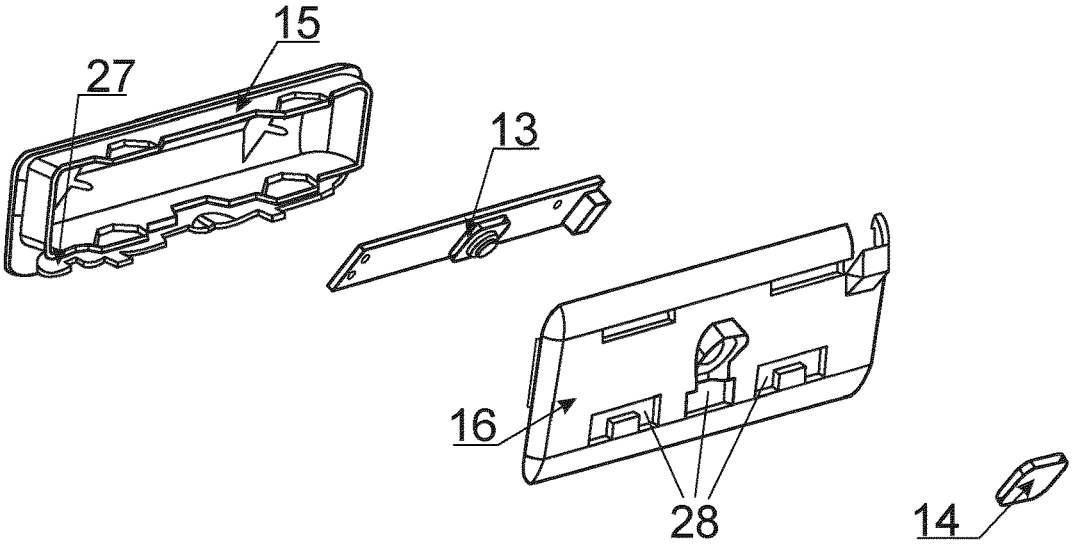
FIG. 8C illustrates an exploded view of the camera assembly shown in FIGS. 8A and 8B.

While such air streams through the gaps between pane elements 9, 10 and 11 air illustrated in FIG. 7 as air streams 21, the cooling of the camera assembly 7 can be further improved by providing an air flow through the housing of the camera assembly 7 and in particular by providing for an air flow wherein ambient air is drawn into the housing, which air flow is depicted in FIG. 7 as stream 22. To this end the housing of the camera assembly 7 can be modified as shown in FIGS. 8A-C which illustrate a camera housing that differs from the one shown in FIGS. 6A-C in that the first housing element 15 along its bottom edge comprises air inlet openings 27 and the second housing element 16 comprises air outlet openings 28.

In operation of the oven and when the fan is operated, as it is illustrated in FIG. 7, air will be drawn into the gaps between the pane elements via the air inlet 60 provided along the bottom edge of the door assembly (see FIG. 1) to flow as streams 21 through the door assembly to be vented via vent channel 17 and chamber 56. Additionally, ambient air is drawn into the camera housing as stream 22 via the air inlet openings 27 in the first housing element 15, exits the housing via the air outlet openings 28 in the second housing element 16, and passes along lens 14 while joining the air flow 21 within the gap between outer pane element 9 and center pane element 12.

Figure 9:
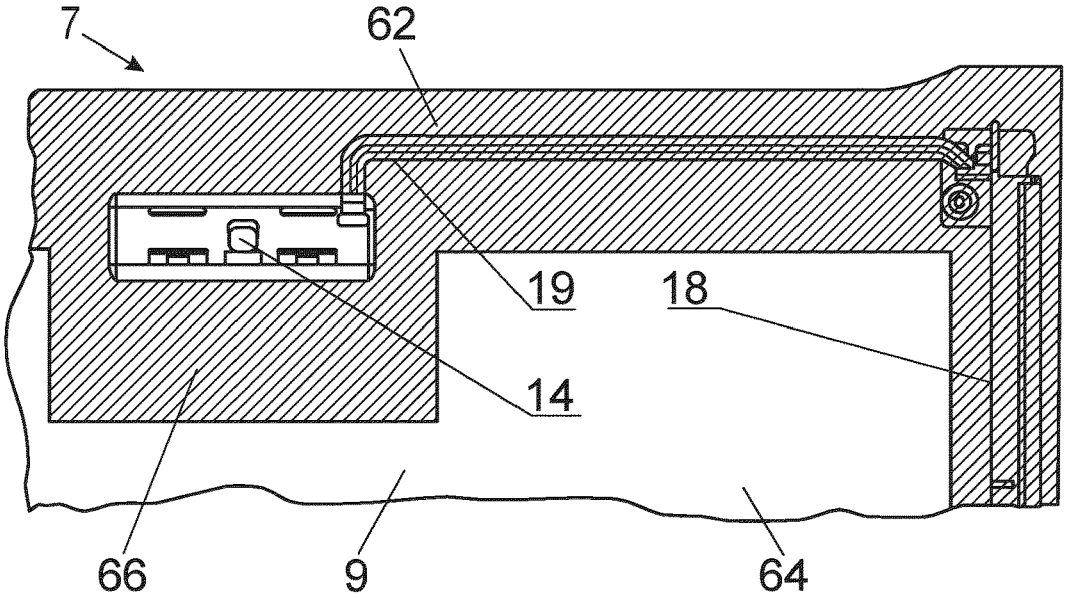
FIG. 9 illustrates a schematic rear view of the upper portion of a door assembly in accordance with the present invention.

FIG. 9 illustrates the upper portion of a rear side of a pane element 9 in which there is mounted a camera assembly 7. The pane element is provided at its rear side with a printed frame 62 which extends along the edge of the pane element so as to cover any structural components that are to be concealed, but to leave a transparent viewing window 64 in the central region of the pane.

A cable channel 19 is attached to the pane and extends from the camera assembly 7 to a door column 18 where the door assembly is hinged to the oven housing. The cable channel 19 is provided to accommodate a cable that connects the camera assembly 7 with other parts of the oven assembly, such as a control unit or an interfacing unit (not shown).

As will be understood from the foregoing description the aperture for accommodating the camera assembly basically can be arranged in any of the pane elements of the door assembly. In ovens in which higher temperatures are reached in the oven cavity it may be advantageous to install the camera assembly in the outermost pane elements or in a center pane element next to the outer pane element.

Furthermore, while the camera assembly can be placed at any position in the respective pane element, there also may be provided more than one camera assembly which may be helpful when several regions of the oven, such as plural trays of the oven shall be monitored.

LIST OF REFERENCE SIGNS

5 oven cavity
6 door assembly
7 camera assembly
8 longitudinal axis of optical sensor
9. outer pane element
10 inner pane element
11 center pane element
12 center pane element
13 printed circuit board
14 lens
15 first housing element
16 second housing element
17 vent channel
18 door column
19 cable channel

21 air stream
22 air stream
23 microwave shielding mesh
24 handle
25 aperture
26 mesh frame
27 air inlet opening
28 air outlet opening
30 upper frame element
32 lower frame element
34 fixture
36 frame element
38 optical sensor
40 circumferential wall
42 protruding rim of 15
44 slot
46 elevated section of 40
48 pawl
50 protruding rim of 16
52 slanted support element
54 longitudinal axis of 38
56 chamber
58 opening
60 air inlet
62 printed frame
64 viewing window
66 anti-reflection section

The invention claimed is:

1. A door assembly for selectively providing access to, or closing, an oven cavity of an oven appliance, the door assembly comprising:

a first pane comprising an at least partially transparent region;

a second pane spaced apart from the first pane and comprising an at least partially transparent region, wherein the first pane is located outward from the second pane such that the second pane is between the oven cavity and the first pane when the door assembly is mounted to the oven appliance and closes the oven cavity;

a camera assembly comprising an optical sensor for obtaining image data from within the oven cavity; and an aperture provided in the first pane, wherein the aperture accommodates the camera assembly, wherein the camera assembly comprises a housing configured for being mounted in the aperture by a snap-fit connection.

2. The door assembly of claim 1, comprising at least one center pane located between the first pane and second pane, the at least one center pane comprising an at least partially transparent region.

3. The door assembly of claim 1, wherein the housing comprises one or more pawls for fixing the camera assembly within the aperture.

4. The door assembly of claim 1, wherein the housing comprises a first housing element configured to be mounted at the aperture at a first side of the first pane, the housing further comprising a second housing element configured to be mounted at the aperture at a second side of the first pane, opposite the first side.

5. The door assembly of claim 4, wherein the first and second housing elements are configured for engaging each other.

6. The door assembly of claim 1, wherein the housing comprises at least one housing aperture for flowing air through the housing.

7. The door assembly of claim 6, said at least one housing aperture of the housing comprises a first housing aperture in a region of the housing located on a first side of the first pane, and a second housing aperture in a region of the housing located on a second side of the first pane, opposite the first side.

8. The door assembly of claim 1, wherein the first pane is an outer pane defining an exterior side surface of the door assembly that faces away from the oven cavity when the door assembly is mounted to the oven appliance and closes the oven cavity.

9. The door assembly of claim 1, further comprising one or more support elements configured to mount the first pane and second pane in a spaced relationship.

10. The door assembly of claim 1, wherein at least the first and/or second pane comprises regions in which transparency of the pane is reduced or eliminated.

11. The door assembly of claim 1, further comprising an anti-reflection element that prevents or reduces light transmissivity of selected areas of the first pane.

12. The door assembly of claim 11, wherein the first pane comprises a coating or printing at least in the vicinity of the camera assembly.

13. A cooking oven comprising the door assembly of claim 1.

14. The cooking oven of claim 13, comprising a source for microwave radiation, wherein the door assembly comprises a microwave shielding mesh mounted alongside one of the first and second panes, the cooking oven further comprising an image evaluation unit configured to analyze the camera images, to detect disturbances caused by the microwave shielding mesh, and to compensate these disturbances by processing data of the image.

15. The door assembly of claim 1, wherein:

an air gap is disposed between the first and second panes;

the housing is mounted within the aperture and configured to secure the camera assembly to the first pane, and the optical sensor is arranged within said housing and inclined with respect to said first pane such that the optical sensor is configured to obtain image data from within a cavity of said oven appliance when the door assembly is mounted to the oven appliance, the camera assembly comprises a lens disposed in a lens opening of the housing and optically aligned with the optical sensor; and the housing of said camera assembly protrudes into said air gap such that an air flow through said air gap will provide cooling to said camera assembly during use via convective heat transfer therewith.

16. The door assembly of claim 15, said housing further comprising a first cooling opening therein at a first side of said first pane, and a second cooling opening therein at a second side of said first pane, wherein said air flow through said air gap will induce a flow of cooling air from a space adjacent to the first side of the first pane through said first cooling opening, through said housing and then out therefrom through said second cooling opening, into said air gap.

17. The door assembly of claim 15, said first pane being an intermediate pane of the door assembly and said second pane being an inner pane of the door assembly configured to be disposed adjacent to the cavity of said oven appliance when the door assembly is mounted to the appliance; said door assembly further comprising an outer pane having an at least partially transparent region; a microwave shielding mesh disposed along a face of the inner pane; and a processor adapted to analyze image data from the optical sensor; said optical sensor being aimed to gather the image data from within said oven cavity during use through said microwave shielding mesh and through said inner pane; wherein said processor is configured to apply an algorithm to the image data in order to eliminate therefrom disturbances introduced by the microwave shielding mesh.

18. The door assembly of claim 15, said housing comprising a first housing portion inserted and received through said aperture in said first pane from the first side thereof; and a second housing portion inserted and received through said aperture from the second side thereof; said first and second housing portions being disposed in locking engagement with one another.

19. The door assembly of claim 1, wherein the housing is mounted in the aperture and the optical sensor is arranged within the housing, such that the optical sensor is arranged at least partially within the aperture in the first pane.

* * * * *